US007490919B2

(12) United States Patent
Combs et al.

(10) Patent No.: US 7,490,919 B2
(45) Date of Patent: Feb. 17, 2009

(54) FLUID-DISPENSING DEVICES AND METHODS

(75) Inventors: Gregg Alan Combs, Monmouth, OR (US); Karen McPheeters, Corvallis, OR (US); Jeff Hess, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 269 days.

(21) Appl. No.: 11/142,625

(22) Filed: Jun. 1, 2005

(65) Prior Publication Data

US 2006/0274104 A1 Dec. 7, 2006

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 4,404,638 | A | 9/1983 | Yada et al. | |
| 4,720,800 | A | 1/1988 | Suzuki et al. | |
| 4,847,794 | A | 7/1989 | Hrubes | |
| 5,237,523 | A | 8/1993 | Bonne et al. | |
| 5,544,531 | A | 8/1996 | Heckman | |
| 5,831,175 | A | 11/1998 | Fletcher-Haynes | |
| 6,079,821 | A | 6/2000 | Chwalek et al. | |
| 6,102,514 | A | 8/2000 | Otsuka et al. | |
| 6,431,673 | B1 * | 8/2002 | Heim et al. | 347/19 |
| 6,450,024 | B1 | 9/2002 | McCulloch et al. | |
| 2005/0005710 | A1 | 1/2005 | Sage, Jr. | |

* cited by examiner

*Primary Examiner*—Julian D Huffman

(57) ABSTRACT

An embodiment includes determining a temperature change of a fluid-ejecting substrate, and determining a mass of fluid ejected from the fluid-ejecting substrate from the temperature change of the fluid-ejecting substrate.

34 Claims, 6 Drawing Sheets

FLUID-DISPENSING DEVICES AND METHODS

BACKGROUND

It is often desirable to determine fluid-dispense rates from fluid-ejecting substrates, e.g., similar to those used for thermal or piezoelectric ink-jet print heads. Exemplary applications include fluid-ejecting substrates used as fuel injectors, IV dispensers, inhalation devices, such as nebulizers, fluid-ejecting substrates used to deposit drugs on a substrate, etc. Present methods for determining fluid-dispense rates are usually complicated, destructive, or time consuming.

DETAILED DESCRIPTION

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
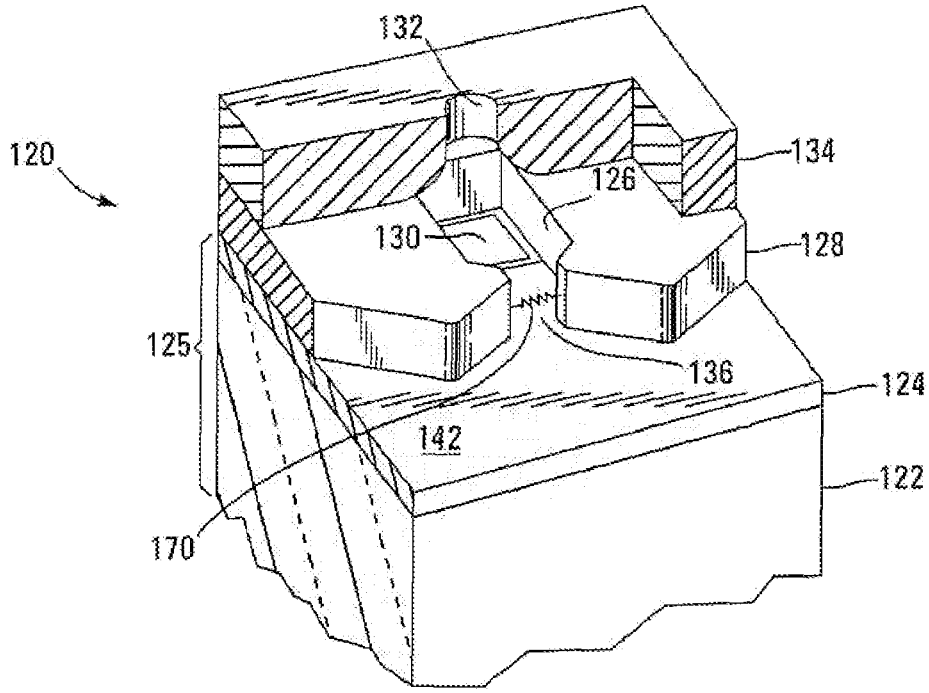
FIG. 1 is a perspective cutaway view of a portion of an embodiment of a fluid-ejecting substrate, according to an embodiment of the disclosure.

FIG. 1 is a perspective cutaway view of a portion of a fluid-ejecting substrate 120, according to an embodiment. For one embodiment, fluid-ejecting substrate 120 may be used as a print head, a fuel injector, an IV dispenser, or an inhalation device, such as a nebulizer, as well as to deposit drugs on a substrate, deposit color filters onto display media, deposit adhesives onto substrates, etc.

Fluid-ejecting substrate 120 includes a wafer 122, e.g., of silicon. A dielectric layer 124, such as a silicon dioxide layer, is formed on wafer 122. For one embodiment, a barrier layer 128 is formed on dielectric layer 124. For another embodiment, chambers 126, e.g., often called firing chambers, as illustrated by a single chamber in FIG. 1, are formed in barrier layer 128. A resistor 130 is formed in each chamber 126 on dielectric layer 124 for one embodiment. Resistor 130 may be covered with suitable passivation and other layers, as is known in art, and connected to conductive layers that transmit current (or voltage) pulses for heating the resistors.

Figure 2:
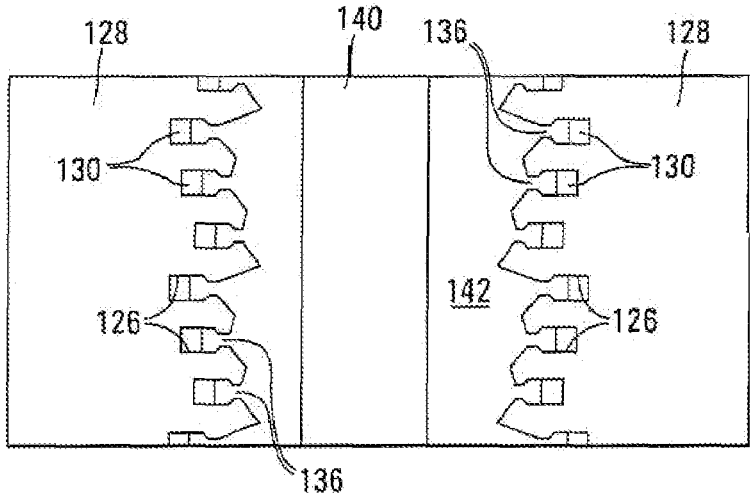
FIG. 2 is a top plan view of an embodiment of the fluid-ejecting substrate, according to an embodiment of the disclosure.

Liquid droplets are ejected from chambers 126 in response to heating the resistors. The liquid droplets are ejected through orifices (or nozzles) 132 (one of which is shown cut away in FIG. 1) formed in an orifice plate 134 formed on barrier layer 128 and aligned so that each chamber 126 is continuous with one of the orifices 132. Chambers 126 are refilled with liquid after each droplet is ejected. In this regard, each chamber is continuous with a refill channel 136 that is formed in the barrier layer 128. The channels 136 extend toward an elongated feed channel 140 that is formed through the substrate, as shown in FIG. 2, a top plan view. Thus, refill liquid flows through the feed channel 140, e.g., out of the plane of FIG. 2. The liquid then flows across the top 142 (that is, to and through the channels 136 and beneath the orifice plate 134) to fill the chambers 126. For one embodiment, fluid-ejecting substrate 120 may be integral with a liquid-containing reservoir or may be coupled to a separate liquid-containing reservoir, e.g., by a conduit.

Figure 3:
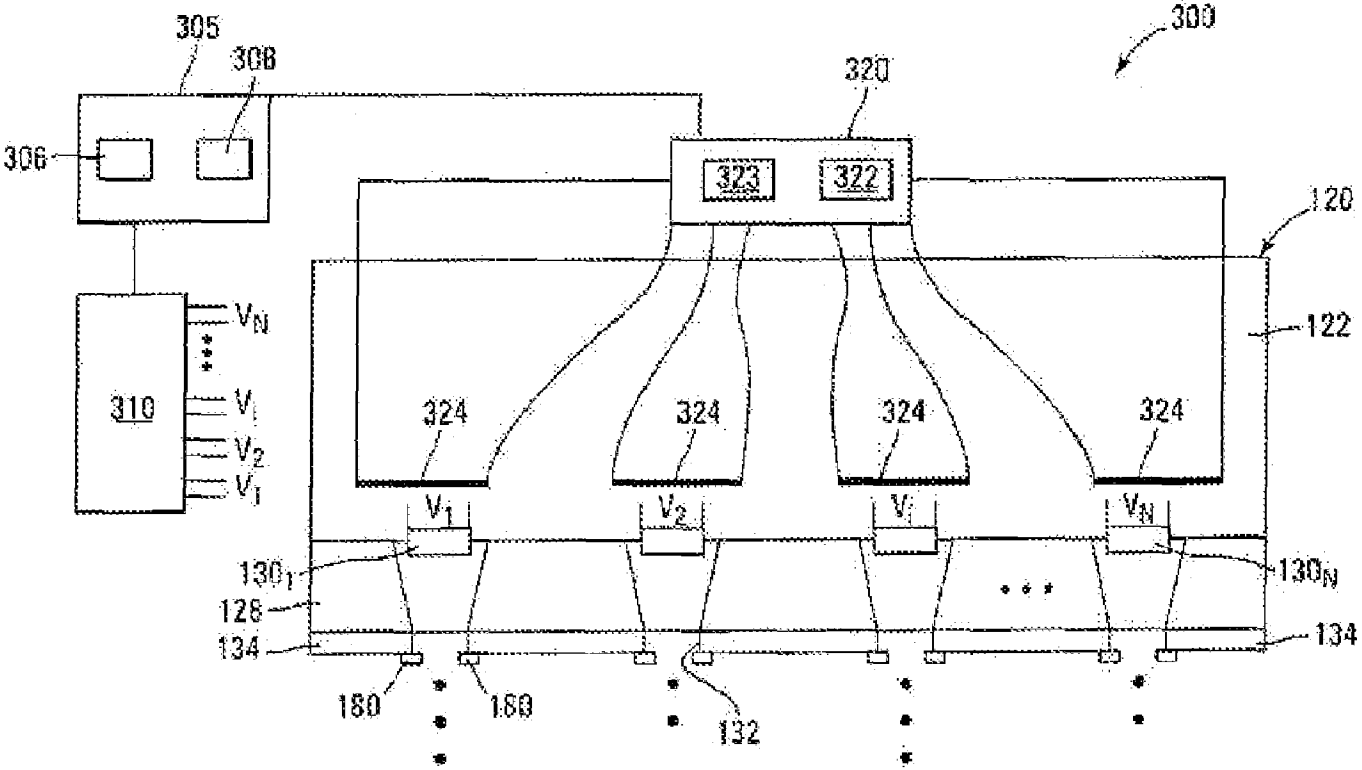
FIG. 3 illustrates a portion of an embodiment of a fluid-dispensing device, according to an embodiment of the disclosure.

FIG. 3 illustrates a portion of a fluid-dispensing device 300, according to an embodiment. For one embodiment, fluid-dispensing device 300 may be used for depositing a marking fluid, e.g., ink, on media, such as, paper, transparent plastic, etc., injecting fuels into combustors, dispensing inhalants into a user's mouth or nose, depositing drugs or medicines on media, such as a media that dissolves when ingested by an animal or human, depositing drugs or medicines into an IV, depositing color filters onto display media, depositing adhesives onto substrates, etc.

Fluid-dispensing device 300 includes fluid-ejecting substrate 120, shown in cross-section, with the cross-hatching omitted for clarity. For one embodiment, a controller 305 is connected to a voltage source 310 and a data acquisition unit 323. For another embodiment, controller 305 includes a processor 306 for processing computer/processor-readable instructions. These computer-readable instructions, for performing the methods described herein, are stored on a computer-usable media 308, and may be in the form of software, firmware, or hardware. As a whole, these computer-readable instructions are often termed a device driver. In a hardware solution, the instructions are hard coded as part of a processor, e.g., an application-specific integrated circuit (ASIC) chip. In a software or firmware solution, the instructions are stored for retrieval by the processor 306. Some additional examples of computer-usable media include static or dynamic random access memory (SRAM or DRAM), read-only memory (ROM), electrically-erasable programmable ROM (EEPROM or flash memory), magnetic media and optical media, whether permanent or removable. Most consumer-oriented computer applications are software solutions provided to the user on some removable computer-usable media, such as a compact disc read-only memory (CD-ROM).

In response to instructions from controller 305, voltage source 310 selectively sends voltage pulses $V_1$ to $V_N$ respectively to resistors $\mathbf{130}_1$ to $\mathbf{130}_N$, where the voltage pulses $V_1$ to $V_N$ each has a pulse time, in seconds, of $\Delta t$. One or more thermal sensors 324 are disposed on wafer 122 for monitoring the temperature of fluid-ejecting substrate 120 by measuring the temperature of fluid-ejecting substrate 120 at a high enough frequency to capture the system's overall thermal dynamics. For one embodiment, each thermal sensor 324 is connected to a temperature measurement unit 320. For one embodiment, each of the thermal sensors 324 is a temperature sense resistor or temperature sense diode. For another embodiment, temperature measurement unit 320 includes circuitry 322 for measuring the resistance of each of the temperature sense resistors. Circuitry and methods for measuring the resistance of temperature sense resistors are well known in the art. For one embodiment, a data acquisition unit 323 of temperature measurement unit 320 receives analog signals from temperature sensors 324 or from circuitry 322, converts them into digital signals, and sends them to controller 305.

For one embodiment, fluid-ejecting substrate 120 includes a plurality (or bank) of nozzles 132 and resistors 130 in planes parallel to the plane of FIG. 3. Moreover, each of these planes (or banks) includes one or more thermal sensors 324 connected to temperature measurement unit 320. For other embodiments, the individual thermal sensors 324 may be connected to form a single continuous thermal sensor. For one embodiment, there may be a single continuous thermal sensor in each of the planes parallel to the plane of FIG. 3.

For another embodiment, resistors 130 may be replaced with actuators, such as piezoelectric actuators. For this embodiment, voltage pulses, e.g., from voltage source 310, are applied to the piezoelectric actuators, causing them to expand. The expansion acts to eject the fluid from chambers 126 (FIGS. 1 and 2). Further, for this embodiment, a resistor 170 is disposed in each refill channel 136, as shown in FIG. 1. Each resistor 170 preheats the fluid before the fluid enters the corresponding chamber 126 in response to heating voltage pulses from voltage source 310, which can be globally addressed to pre-warm the fluid in all firing chambers.

For other embodiments, pre-pressurized fluid is supplied to each of chambers 126 via channels 136 and feed channel 140 from a pressurized fluid reservoir, located externally of fluid-ejecting substrate 120, for preselected instants of time, such as is commonly done for continuous inkjet (CIJ) printing, and is ejected under pressure though nozzles 132. For these embodiments, the fluid is continuously supplied under pressure by feed channel 140. For a non-fluid ejecting state, the fluid is blocked from entering channels 136 by a deflector (or gutter) (not shown), the use of which is well known in the art. For these embodiments, the fluid may be preheated using resistors 130 or 170 prior to ejection. For another embodiment, a heater 180 may be located at an outlet of each nozzle 132, as shown in FIG. 3, for breaking the fluid into drops, as is known in the art, in response to voltage pulses from voltage source 310.

For each voltage pulse supplied by voltage source 310, the energy input to fluid-ejecting substrate 120 is determined from $$E_{in}=[(\Delta t\times V^2)/R]_{in} \tag{1}$$

where R is the total resistance of the number of resistors 130, 170, or 180 activated during the pulse. The primary energy output from fluid-ejecting substrate 120 for each voltage pulse is determined from $$E_{out}=(mc_p\Delta T)_{out} \tag{2}$$

where $m_{out}$, $c_{p\ out}$, and $\Delta T_{out}$ are respectively the mass of the ejected liquid, specific heat of the ejected liquid, and the temperature change of the ejected liquid. It will be appreciated by those of skill in the art that $E_{out}$ may include various energy losses, e.g., convective losses to the environment and ink supply source as well as conduction losses to a body integral with fluid-ejecting substrate 120. The energy stored in fluid-ejecting substrate 120 is determined from $$E_{subs}=(mc_p\Delta T)_{subs} \tag{3}$$

where $m_{subs}$, $c_{p\ subs}$, and $\Delta T_{subs}$ are respectively the mass of fluid-ejecting substrate 120, specific heat of fluid-ejecting substrate 120, and the temperature change of fluid-ejecting substrate 120. Note that this embodiment assumes that the entire mass $m_{subs}$ experiences the same temperature change, i.e., a substantially infinitesimal temperature propagation time through mass $m_{subs}$.

The mass of the ejected liquid may be determined from an energy balance on fluid-ejecting substrate 120, as follows:

$$E_{out}=E_{in}-E_{subs} \tag{4}$$

Substituting equations (1)-(3) into equation (4), gives $$(mc_p\Delta T)_{out}=[(\Delta t\times V^2)/R]_{in}-(mc_p\Delta T)_{subs} \tag{5}$$

Each term on the right side of equation (5) either can be determined from measurements or is a known property. For one embodiment, $\Delta T_{subs}$ can be measured using thermal sensors 324, where $\Delta T_{subs}$ is the difference between the measured temperature of fluid-ejecting substrate 120 at the end of the voltage pulse and the measured temperature at the start of the voltage pulse. Note that for this embodiment it is assumed that the entire mass $m_{subs}$ experiences the same temperature change as temperature sensor 324. This enables the energy of the ejected liquid for each voltage pulse to be determined.

Note that summing (or integrating) the right side of equation (5) over a predetermined number of voltage pulses gives the total energy of the ejected liquid for the predetermined number of voltage pulses. Note further that Δt and/or R may vary from pulse to pulse, where the variation in R is due to the variation in the number of resistors 130 activated for each pulse. Note, too, that for large number of pulses, a steady state may occur, reducing equation (4) to $E_{out}=E_{in}$, i.e., the energy storage term $E_{subs}$ drops out. For another embodiment, the first term on the right side of equation (5), the energy in, is substantially constant, as are $m_{subs}$, $c_{p\ subs}$ of the second term on the right side of equation (5), the stored energy. This suggests that the ejected mass $m_{out}$ correlates with the temperature change of fluid-ejecting substrate 120 $\Delta T_{subs}$ or the sum (or integral) of $\Delta T_{subs}$ over a plurality of voltage pulses.

Since the mass of the ejected liquid $m_{out}$ is the quantity that is to be determined, and $\Delta T_{out}$ cannot be easily determined, a calibration equation (or curve or look-up table) is used. For one embodiment, the calibration equation determined as follows: The fluid ejecting substrate is operated under the same conditions as the intended application, and the ejected mass is collected and determined for different values of the right side of equation (5), e.g., by blocking some percentage of the fired nozzles so that $E_{in}$ is constant in all cases but $E_{out}$ varies depending on how many nozzles are capable of firing. The calibration equation can then be used to determine the ejected mass for values of the right side of equation (5), i.e., the energy of the ejected fluid, during actual operation. For another embodiment, a calibration equation may be determined by operating the fluid ejecting substrate and collecting and measuring the ejected mass for different values of the temperature change of fluid-ejecting substrate 120 $\Delta T_{subs}$ or the integral of $\Delta T_{subs}$ over a plurality of voltage pulses. This calibration equation can then be used to determine the ejected mass for different values of the temperature change of fluid-ejecting substrate 120 $\Delta T_{subs}$ or the integral of $\Delta T_{subs}$ over a plurality of voltage pulses, during actual operation. Note that for one embodiment, the calibration equations are obtained under substantially the same conditions that are encountered during actual operation of the fluid ejecting substrate. In this way, the calibration equations account for the various energy losses discussed above.

Figure 4:
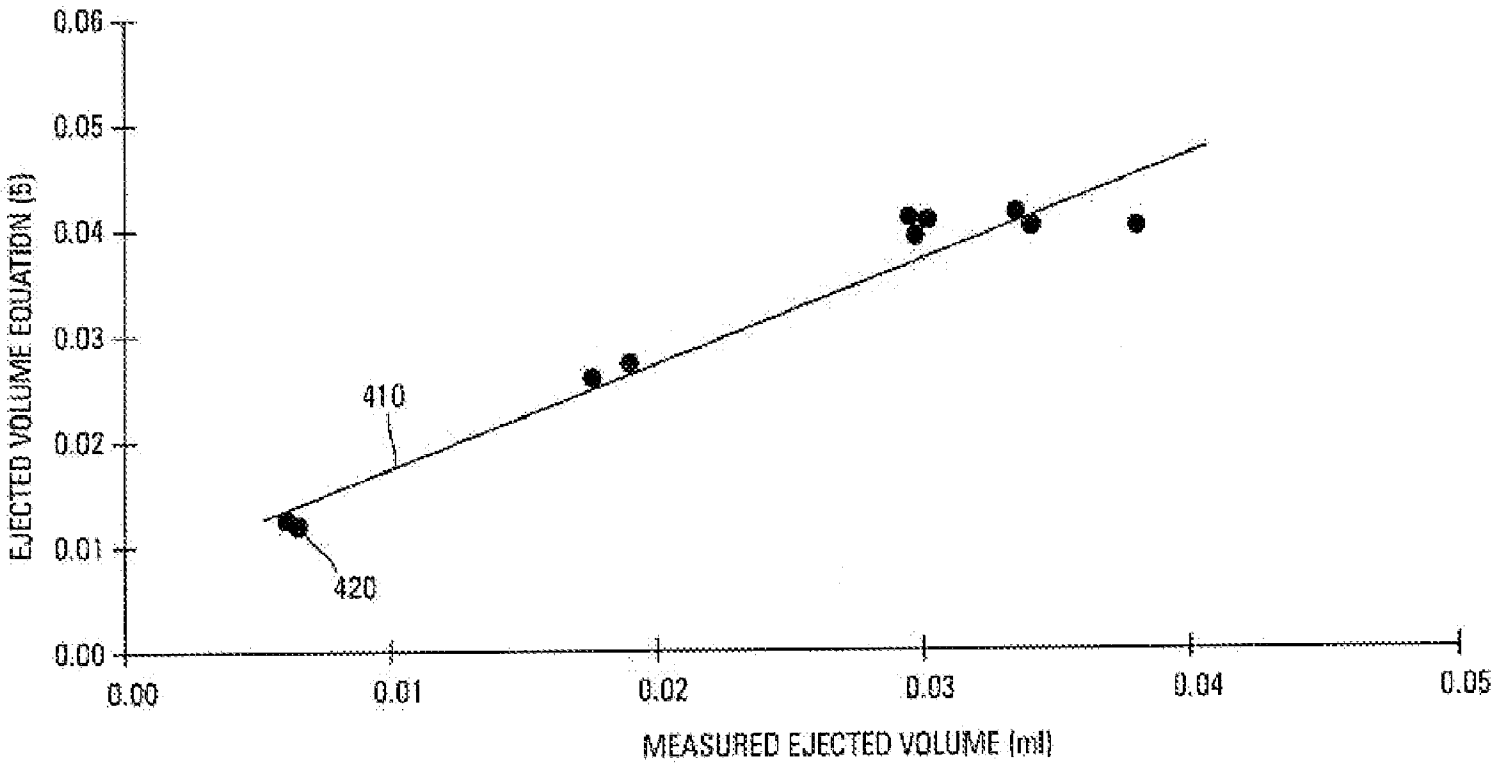
FIG. 4 illustrates an example of a correlation, according to an embodiment of the disclosure.

FIG. 4 illustrates an example, for a plurality of voltage pulses, of how well a volume of ejected mass (data points 420) determined from a calibration equation in conjunction with the integral of $\Delta T_{subs}$ over the plurality of voltage pulses correlates with a volume of ejected mass (a best-fit line 410) determined by ejecting the volume on a target and measuring the ejected volume using High Performance Liquid Chromatography (HPLC).

Figure 5A:
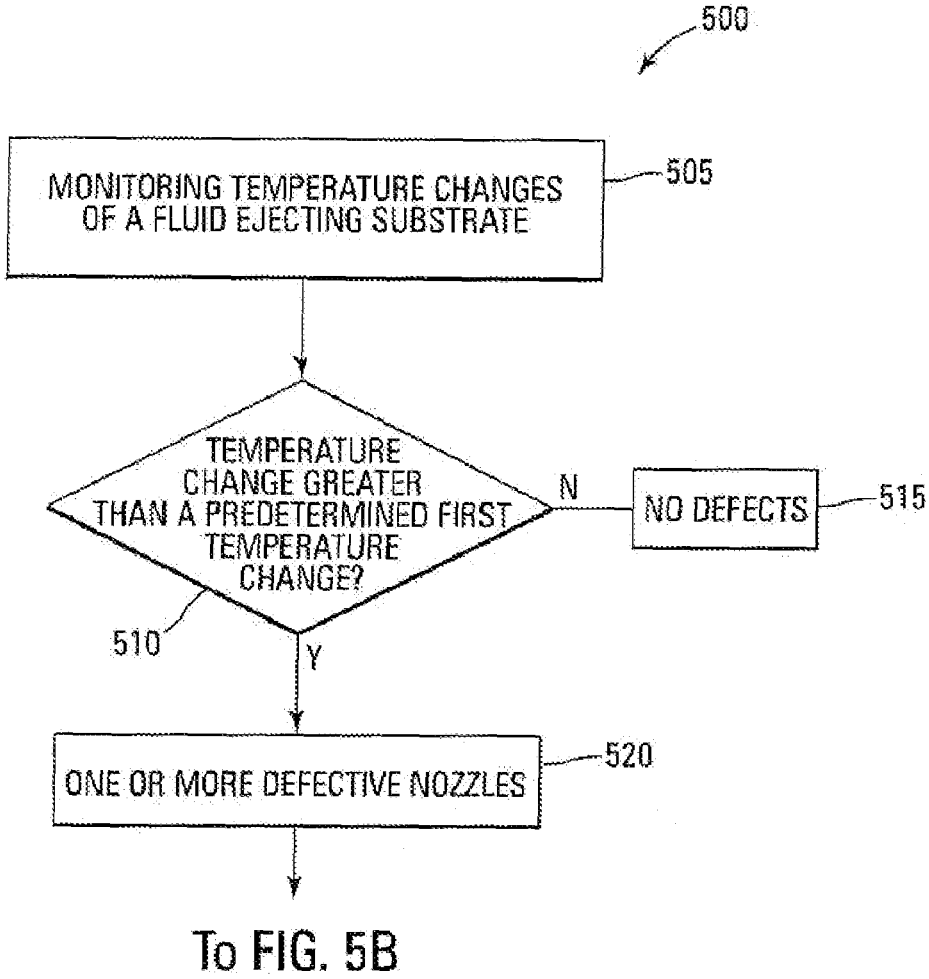
FIGS. 5A-5C include a flowchart of an embodiment of a method, according to another embodiment of the disclosure.
Figure 5B:
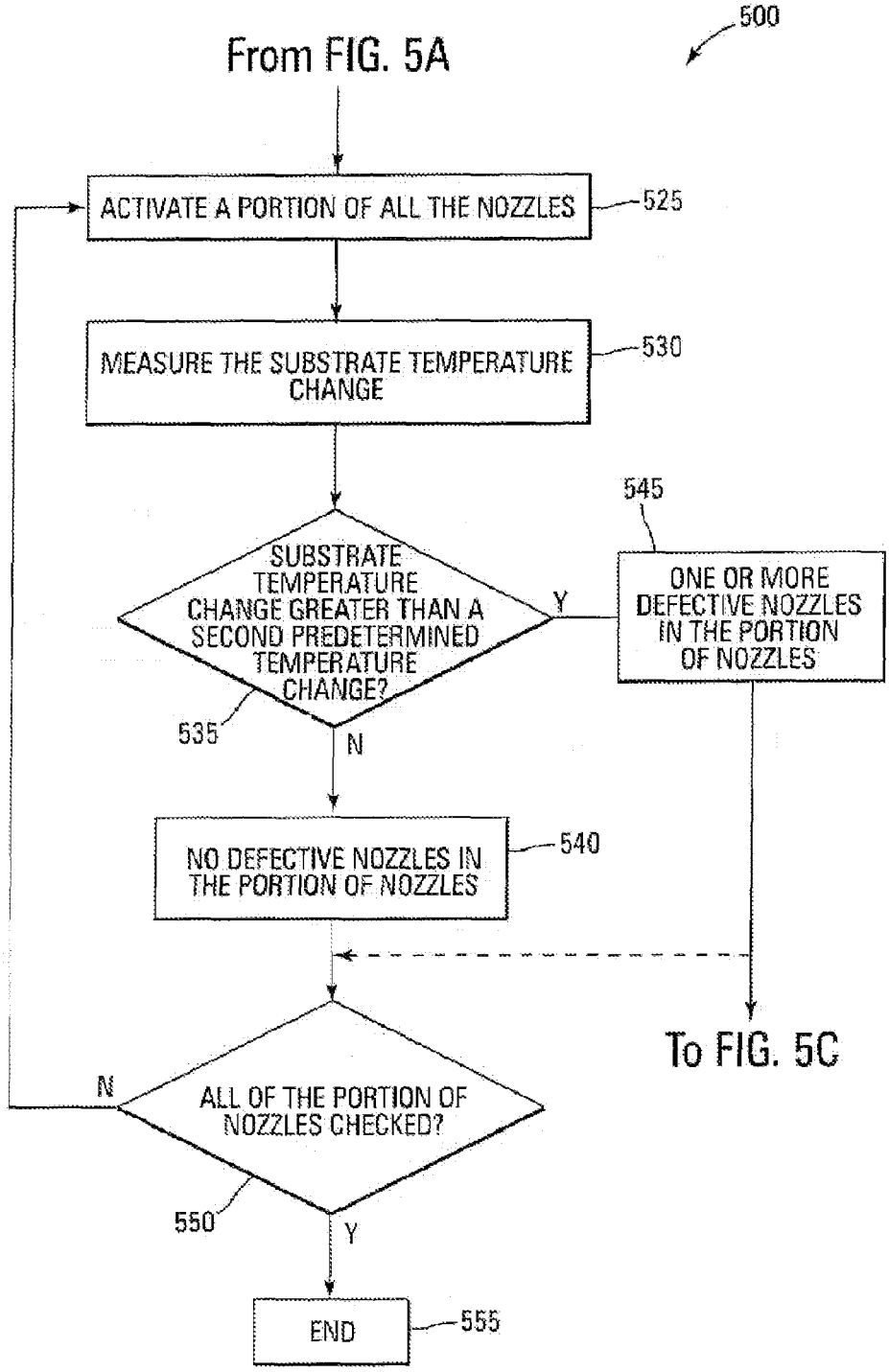
Figure 5C:
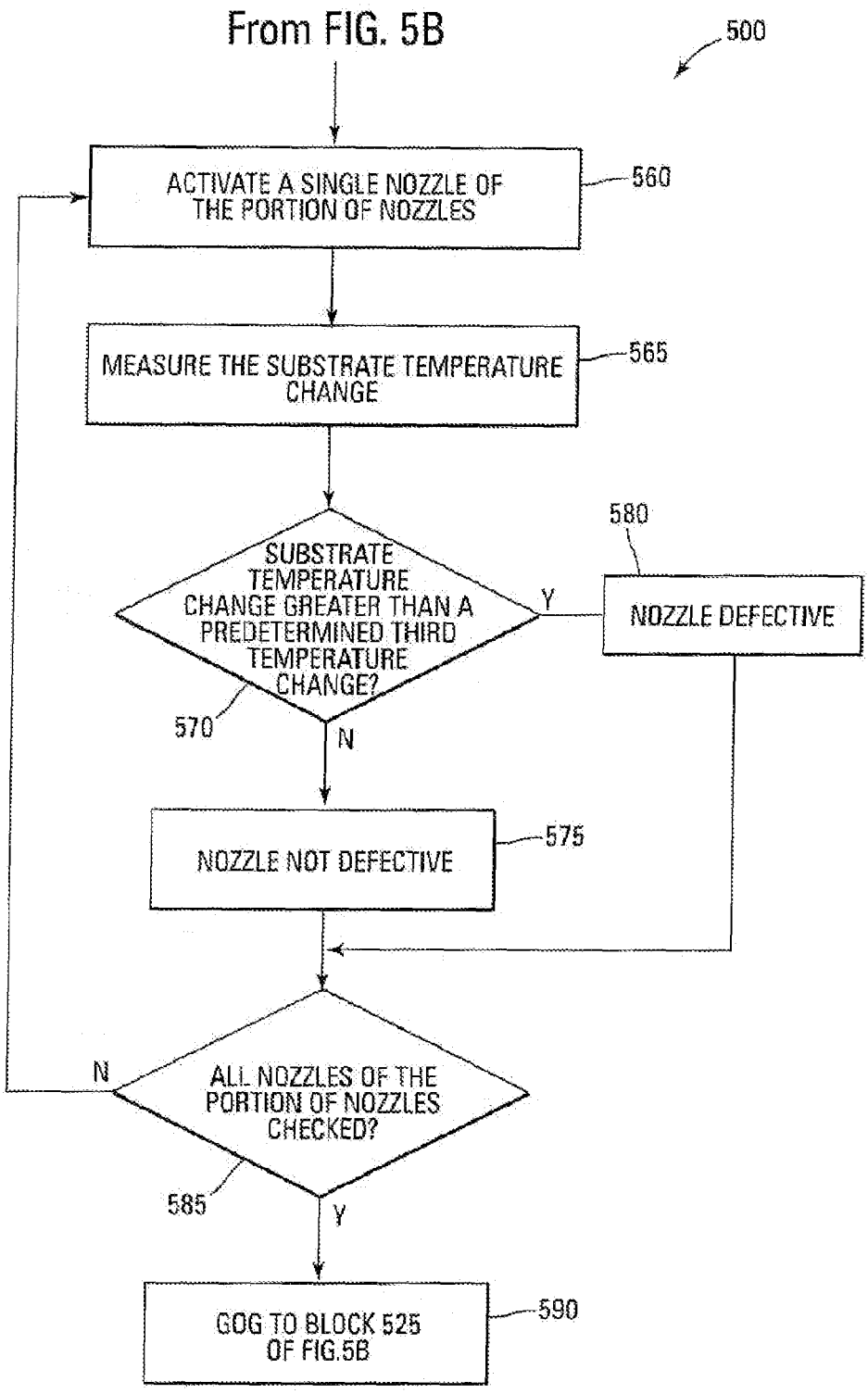

FIGS. 5A-5C include a flowchart of a method 500 for identifying one or more defective nozzles 132, e.g., clogged, partially clogged nozzles or air bubbles trapped near refill channel 136, preventing chamber 126 from refilling, according to another embodiment. If one or more nozzles are defective, the temperature (or temperature change) of fluid-ejecting substrate 122 will increase relative to when there are no defective nozzles. At block 505 of FIG. 5A, the temperature change, e.g., the temperature increase corresponding to one or more voltage pulses, of fluid-ejecting substrate 122 is monitored. If the temperature change of fluid-ejecting substrate 122 does not exceed a first predetermined temperature change at decision block 510 (FIG. 5A), it is indicated that there are no defective nozzles at block 515. Otherwise, it is likely that there are one or more defective nozzles, and it is indicated that there are one or more defective nozzles at block 520 (FIG. 5A). For one embodiment, the method may stop here, and the fluid-ejecting substrate 122 may be indicated as defective.

Optionally, for another embodiment, after determining that one or more nozzles are defective, the method continues in FIG. 5B. At block 525, a portion of the nozzles is activated. Note that activation may include firing the resistors 130 for that portion, activating piezoelectric actuators for that portion and activating resistors 170 corresponding thereto, or directing a pre-pressurized fluid through that portion of nozzles and either activating resistors, 130, 170, or 180 corresponding thereto. For one embodiment, the portion of the nozzles may correspond to a portion of fluid-ejecting substrate 122, such as to a block or row of nozzles, nozzles corresponding to a particular address, etc.

At block 530, the temperature change, e.g., temperature increase, of fluid-ejecting substrate 122 is measured. If the temperature change of fluid-ejecting substrate 122 does not exceed a second predetermined temperature change at decision block 535, it is indicated that the portion of nozzles is not defective at block 540. Otherwise, it is likely that one or more nozzles are defective, and it is indicated that one or more nozzles of the portion of nozzles are defective at block 545. For one embodiment, the method proceeds to decision block 550, as indicated by the dashed line between block 545 and decision block 550. For this embodiment, if all the portions of nozzles have been checked at decision block 550, the method ends at block 555. Otherwise, the method continues until all of the portions of nozzles have been checked.

Optionally, for another embodiment, after determining that one or more nozzles of a portion of nozzles are defective, the method may proceed from block 545 of FIG. 5B to block 560 of FIG. 5C, where a single nozzle of the portion of nozzles, indicated as defective at block 545, is activated. At block 565, the temperature change, or temperature increase, of fluid-ejecting substrate 122 is measured. If the temperature change of fluid-ejecting substrate 122 does not exceed a third predetermined temperature change at decision block 570, it is indicated that the nozzle is not defective at block 575. Otherwise, it is likely that the nozzle is defective, and it is indicated that the nozzle is defective at block 580. If all the nozzles have been checked at decision block 585, the method returns to block 525 of FIG. 5B, as indicated at block 590. Otherwise, the method continues until all of the nozzles of that portion have been checked.

For another embodiment, the first, second, and/or third predetermined temperature changes may be equal. For this embodiment, activating a portion of nozzles at block 525 of FIG. 5B or activating a single nozzle at block 560 of FIG. 5C occurs a plurality of times until the energy input to fluid-ejecting substrate 122 is substantially enough to measure via the temperature sensors. Then, the temperature change measurement at block 535 of FIG. 5B and/or at block 565 of FIG. 5C involves measuring the temperature change for each activation and summing (or integrating) the temperature changes over the number of activations.

For one embodiment, the first, second, and third predetermined temperature changes may be determined using experimental simulations where one or more nozzles are defective. For another embodiment, fluid-ejecting substrates with known nozzle defects may be used in the simulations. For some embodiments, the simulations are performed under substantially the same operating conditions as the actual operation of fluid-ejecting substrate 122. For other embodiments, the second predetermined temperature change may be determined using fluid-ejecting substrates known to have at least one portion with one or more nozzle defects, while the first predetermined temperature change may be determined using fluid-ejecting substrates known to have one or more nozzle defects. For another embodiment, the third predetermined temperature change may be determined using fluid-ejecting substrates known to have a single nozzle defect.

Note that since it is likely that more nozzles are active during operation of the fluid-ejecting substrate than when a portion of the fluid-ejecting substrate is being operated, and the first predetermined temperature difference is likely to be higher than the second predetermined temperature difference for some embodiments. Moreover, for other embodiments, it is likely that more nozzles are active when a portion of the fluid-ejecting substrate is being operated than when a single nozzle is being operated, the second predetermined temperature difference is likely to be higher than the third predetermined temperature difference.

For another embodiment, if the mass ejected from the fluid-ejecting substrate, determined as described above, falls below an expected ejected mass during a particular activation event, e.g., including one or more activation pulses, the current or subsequent activation event may be extended until the mass ejected from the fluid-ejecting substrate is substantially equal to the expected ejected mass.

For another embodiment the, if the mass ejected from the fluid-ejecting substrate, determined as described above, falls below an expected ejected mass during a particular activation event, e.g., including one or more activation pulses, the defective nozzle identification routine (FIGS. 5A-5C) is completed to identify and disable the defective nozzles. In another embodiment the defective nozzles are compensated for via firing alternate nozzles.

CONCLUSION

Although specific embodiments have been illustrated and described herein it is manifestly intended that the scope of the claimed subject matter be limited only by the following claims and equivalents thereof.

What is claimed is:

1. A method for determining a mass of a fluid ejected from a fluid-ejecting substrate, comprising:

determining a temperature change of the fluid-ejecting substrate for one or more activation pulses applied to the fluid-ejecting substrate by taking a difference between a temperature of the fluid-ejecting substrate measured at an end of each of the one of the one or more activation pulses and a temperature of the fluid-ejecting substrate measured at a start of that activation pulse; and determining the mass of the fluid ejected from the fluid-ejecting substrate from the temperature change of the fluid-ejecting substrate for the one or more activation pulses.

2. The method of claim 1, wherein the fluid is pressurized before it arrives at the fluid-ejecting substrate.

3. The method of claim 1, wherein one or more piezoelectric actuators or one or more resistors eject the fluid.

4. The method of claim 1, wherein determining the mass of the ejected fluid from the temperature change of the fluid-ejecting substrate comprises using a calibration equation in conjunction with the temperature change of the fluid-ejecting substrate.

5. The method of claim 1, wherein the ejected fluid is selected from the group consisting of marking fluids, medicines, drugs, color filters, adhesives, and fuels.

6. The method of claim 1, wherein determining a temperature change of the fluid-ejecting substrate comprises summing the temperature changes for the one or more activation pulses.

7. The method of claim 1 further comprises, when the mass of the fluid ejected from the fluid-ejecting substrate falls below an expected value, extending the operation of the fluid-ejecting substrate until the ejected mass is substantially equal to the expected value.

8. A method for determining a mass of a fluid ejected from a fluid-ejecting substrate, comprising:

determining an electrical energy input into the fluid-ejecting substrate;

determining a thermal energy stored in the fluid-ejecting substrate;

determining a thermal energy of the ejected fluid from the electrical energy input and the stored thermal energy; and determining the mass of the ejected fluid from the thermal energy of the ejected fluid.

9. The method of claim 8, wherein determining the thermal energy stored in the fluid-ejecting substrate comprises measuring a temperature of the fluid-ejecting substrate.

10. The method of claim 8, wherein determining the electrical energy input into the fluid-ejecting substrate comprises measuring a voltage applied to one or more resistors for heating the fluid.

11. The method of claim 10, wherein heating the fluid causes the fluid to be ejected.

12. The method of claim 8, wherein the fluid is ejected by piezoelectric actuators or is pressurized before it arrives at the fluid-ejecting substrate.

13. The method of claim 8, wherein determining the mass of the ejected fluid from the thermal energy of the ejected fluid comprises using a calibration equation in conjunction with the thermal energy of the ejected fluid.

14. A method of operating a fluid-dispensing device, comprising:

applying a plurality of voltage pulses to one or more resistors disposed in a fluid-ejecting substrate of the fluid-dispensing device, wherein each voltage pulse causes the one or more resistors to heat a fluid;

determining a temperature change of fluid-ejecting substrate for each pulse by taking the difference between a temperature measured at an end of that pulse and a temperature measured at a start of that pulse;

summing the temperature change for each pulse over the plurality of pulses to determine a temperature change of the fluid-ejecting substrate for the plurality of pulses; and determining a mass of fluid ejected from the fluid-ejecting substrate for the plurality of pulses from the temperature change of fluid-ejecting substrate for the plurality of pulses.

15. The method of claim 14, wherein determining a mass of fluid ejected from the fluid-ejecting substrate for the plurality of pulses from the temperature change of fluid-ejecting substrate comprises using a calibration equation in conjunction with the temperature change of fluid-ejecting substrate for the plurality of pulses.

16. The method of claim 14, wherein the ejected fluid is ejected into a combustor, into a user's mouth or nose as an inhalant, or onto media as a drug, medicine, or into an IV as a drug or medicine, or onto a display material as a color filter, or onto a substrate as an adhesive or marking fluid.

17. A computer-usable medium containing computer-readable instructions for performing a method, comprising:

determining a temperature change of the fluid-ejecting substrate for one or more activation pulses applied to the fluid-ejecting substrate by taking a difference between a temperature of the fluid-ejecting substrate measured at an end of each of the one of the one or more activation pulses and a temperature of the fluid-ejecting substrate measured at a start of that activation pulse; and determining the mass of the fluid ejected from the fluid-ejecting substrate from the temperature change of the fluid-ejecting substrate for the one or more activation pulses.

18. The computer-usable medium of claim 17, wherein, in the method, determining a temperature change of the fluid-ejecting substrate comprises summing the temperature changes for the one or more activation pulses.

19. The computer-usable medium of claim 17, wherein the method further comprises, when the mass of the fluid ejected from the fluid-ejecting substrate falls below an expected value, extending the operation of the fluid-ejecting substrate until the ejected mass is substantially equal to the expected value.

20. The computer-usable medium of claim 17, wherein, in the method, determining the mass of the ejected fluid from the temperature change of the fluid-ejecting substrate comprises using a calibration equation in conjunction with the temperature change of the fluid-ejecting substrate.

21. A fluid-ejection device comprising:

means for ejecting a fluid;

means for determining a temperature change of the fluid-ejecting means for one or more activation pulses applied to the fluid-ejecting means by taking a difference between a temperature of the fluid-ejecting means measured at an end of each of the one of the one or more activation pulses and a temperature of the fluid-ejecting means measured at a start of that activation pulse; and means for determining a mass of fluid ejected from the fluid-ejecting means from the temperature change of the fluid-ejecting means for the one or more activation pulses.

22. The fluid-ejection device of claim 21 further comprises means for determining whether the mass of the fluid ejected from the fluid-ejecting substrate falls below an expected value.

23. The fluid-ejection device of claim 22, further comprises means for extending the operation of the fluid-ejecting substrate if the mass of the fluid ejected from the fluid-ejecting substrate falls below the expected value until the ejected mass is substantially equal to the expected value.

24. A fluid-ejection device comprising:

a fluid-ejecting substrate; and a controller connected to the fluid-ejecting substrate, the controller being configured to execute operations, comprising:

determining a temperature change of the fluid-ejecting substrate for one or more activation pulses applied to the fluid-ejecting substrate by taking a difference between a temperature of the fluid-ejecting substrate measured at an end of each of the one of the one or more activation pulses and a temperature of the fluid-ejecting substrate measured at a start of that activation pulse; and determining the mass of the fluid ejected from the fluid-ejecting substrate from the temperature change of the fluid-ejecting substrate for the one or more activation pulses.

25. The fluid-ejection device of claim 24 further comprises a voltage source connected to the controller and to resistors disposed in the fluid-ejecting substrate.

26. The fluid-ejection device of claim 25, wherein the voltage source is configured to apply the activation pulses to the resistors and the resistors heat the fluid in response to the activation pulses.

27. The fluid-ejection device of claim 25, wherein heating the fluid causes the fluid to be ejected.

28. The fluid-ejection device of claim 25 further comprises one or more thermal sensors connected to the controller.

29. The fluid-ejection device of claim 28, wherein each of the one or more thermal sensors comprises a temperature sense resistor or a temperature sense diode.

30. The fluid-ejection device of claim 24, wherein determining the mass of the ejected fluid from the temperature change of the fluid-ejecting substrate comprises using a calibration equation in conjunction with the temperature change of the fluid-ejecting substrate.

31. The fluid-ejection device of claim 24, wherein the ejected fluid is selected from the group consisting of marking fluids, medicines, drugs, color filters, adhesives, and fuels.

32. The fluid-ejection device of claim 24, wherein determining a temperature change of the fluid-ejecting substrate comprises summing the temperature changes for the one or more activation pulses.

33. The fluid-ejection device of claim 24, wherein the controller is further configured to execute the operation, when the mass of the fluid ejected from the fluid-ejecting substrate falls below an expected value, of extending the operation of the fluid-ejecting substrate until the ejected mass is substantially equal to the expected value.

34. The fluid-ejection device of claim 24, wherein the fluid-ejecting substrate comprises a plurality of piezoelectric actuators connected to the controller for ejecting the fluid from the fluid-ejecting substrate.

* * * * *